United States Patent [19]

Kamat

[11] 4,450,196

[45] May 22, 1984

[54] COMPOSITE FUSIBLE INTERLINING FABRIC AND METHOD

[75] Inventor: Dattatraya V. Kamat, Jenkintown, Pa.

[73] Assignee: Crown Textile Company, Jenkintown, Pa.

[21] Appl. No.: 467,238

[22] Filed: Feb. 17, 1983

[51] Int. Cl.[3] ..... B32B 3/00

[52] U.S. Cl. ..... 428/197; 2/272; 156/148; 156/291; 428/198; 428/253; 428/257

[58] Field of Search ..... 156/148, 291; 428/197, 428/198, 253, 257, 102, 103; 2/272; 66/192, 193, 195

[56] References Cited

U.S. PATENT DOCUMENTS

| | | | |
|---|---|---|---|
| 3,600,259 | 8/1971 | Smith et al. | 428/257 |
| 3,642,561 | 2/1972 | Grobner | 428/102 |
| 3,649,428 | 3/1972 | Hughes | 428/102 |
| 4,304,813 | 12/1981 | Elmore | 428/253 |
| 4,349,593 | 9/1982 | Blechstern | 428/253 |
| 4,350,725 | 9/1982 | Pflüger | 428/253 |
| 4,388,364 | 6/1983 | Sanders | 428/257 |

*Primary Examiner*—James J. Bell

*Attorney, Agent, or Firm*—Bell, Seltzer, Park & Gibson

[57] ABSTRACT

The composite fusible interlining fabric is formed of a layer of nonwoven fabric, a layer of fibrous material positioned against the reverse or rear side of the layer of nonwoven fabric, stitch yarn knit through the layer of nonwoven fabric and the layer of fibrous material and securing them together, and a coating of thermoactive adhesive material on the front or face side of the layer of nonwoven fabric. The layer of nonwoven fabric provides a smooth surface for the coating of thermoactive adhesive material. Additionally, the layer of nonwoven fabric of closely compacted fibers provides a barrier or shield to prevent strike back of the adhesive coating material when the composite interlining fabric is fused to the base or garment fabric.

8 Claims, 4 Drawing Figures

COMPOSITE FUSIBLE INTERLINING FABRIC AND METHOD

FIELD OF THE INVENTION

This invention relates generally to a fusible interlining fabric and more particularly to a composite fusible interlining fabric and method of forming the same which includes a layer of nonwoven fabric and a layer of fibrous material with stitch yarn knit through the layer of nonwoven fabric and the layer of fibrous material.

BACKGROUND OF THE INVENTION

When manufacturing various types of garments, it is the usual practice to attach an ironed-in stiffening insert, usually referred to as an interlining, to the body or base fabric of certain parts of the garment, such as suit, shirt or blouse shoulders, fronts, collars and cuffs. The interlining is normally adhered or fused to the base fabric by a bonding of thermoactive adhesive material applied to one side of the interlining fabric, as by coating, or by printing in spaced deposits or dot patterns. The interlining fabric is then placed adjacent the base fabric with the dot patterns of thermoactive adhesive material in contact with the base fabric and subjected to an ironing or pressing operation so that the thermoactive adhesive material softens and adheres or fuses the interlining fabric to the base fabric.

It is known to produce these interlining fabrics of nonwoven material, knit material, or woven material. The nonwoven interlining fabrics have good cover but do not have the resiliency, drape and the strength properties normally found in knitted and woven interlining fabrics. However, the nonwoven interlining fabrics are sometimes preferred because they have a smooth surface, making it convenient for applying the fusible coating thereto. In many instances, the woven and knitted interlining fabrics are not suitable because they do not have the cover provided by the nonwoven fabrics. While the woven and knitted fabrics have the resiliency and strength, they do not provide the smoothness of surface which is typical of the nonwoven fabrics. Also, the woven and knitted interlining fabrics can present "strike back" problems. Strike back is the tendency of the fusible coating material to flow through the interlining fabric and to the opposite side of the interlining fabric to which the fusible coating material is applied. Such strike back of the thermoactive adhesive material can result in an undesirable bonding between the the lining of the garment and the interlining upon the application of heat and pressure. When the lining of the garment is adhered to the interlining, this effects the drape, feel and appearance of the garment as the garment is designed to have the interlining fabric adhere only to the outer or base fabric of the garment and not to the lining.

SUMMARY OF THE INVENTION

With the foregoing in mind, it is an object of the present invention to provide a composite fusible interlining fabric which includes a layer of nonwoven fabric formed of closely compacted fibers, a layer of fibrous material positioned against one side of the layer of nonwoven fabric, stitch yarn knit through the layer of nonwoven fabric and the layer of fibrous material, and a coating of thermoactive adhesive material being on the side of the layer of nonwoven fabric opposite the side against which the layer of fibrous material is positioned. The layer of nonwoven fabric provides the cover characteristics of nonwoven interlining fabrics while the stitch yarn and the layer of fibrous material (such as spun yarn) provide the strength and resiliency characteristics of knit or woven interlining fabrics. The layer of nonwoven fabric provides a barrier or shield of closely compacted fibers to prevent strike back of the thermoactive adhesive material when the interlining fabric is fused to the base fabric.

In one embodiment of the present composite fusible interlining fabric, the layer of fibrous material is formed of inlaid weft yarns (such as spun yarns) held in position and applied during the knitting of the stitch yarn. In a second embodiment of the composite fusible interlining fabric of the present invention, the layer of fibrous material is formed of a nonwoven fibrous batt, which is thicker than the layer of nonwoven fabric to which the thermoactive adhesive coating is applied.

In each embodiment of the composite fusible interlining fabric of the present invention, the stitch yarn is illustrated as being knit in a warp knit stitch pattern through the layer of nonwoven fabric and the layer of fibrous material. The warp knit stitch pattern may be varied as desired to control the stability, stiffness, shape retention and tensile strength characteristics of the interlining fabric. The presence of the layer of nonwoven fabric on one side of the composite fusible interlining fabric of the present invention provides a relatively smooth surface with the coating of thermoactive adhesive material thereon. The warp knit stitch yarn extending through and connecting the layer of nonwoven fabric and the layer of fibrous material provides strength, bulk, resiliency and drapability to the base garment with the composite fusible interlining fabric fused thereto. The layer of nonwoven fabric provides a barrier or shield of closely compacted fibers to prevent strike back of the thermoactive adhesive coating material when the composite fusible interlining fabric is fused to the garment base fabric.

The composite fusible interlining fabric of the present invention is preferably formed by forming a relatively thin layer of nonwoven fabric of closely compacted fibers and then applying a fusible coating of thermoactive adhesive material to one side of the thin layer of nonwoven fabric. A layer of fibrous material, such as inlaid weft yarns or a nonwoven fibrous batt, is attached to the layer of nonwoven fabric by knitting a stitch yarn through the layer of nonwoven fabric and the layer of fibrous material.

BRIEF DESCRIPTION OF THE DRAWINGS

Other objects and advantages will appear as the description proceeds when taken in connection with the accompanying drawings in which.

DESCRIPTION OF THE ILLUSTRATED EMBODIMENTS

Figure 1:
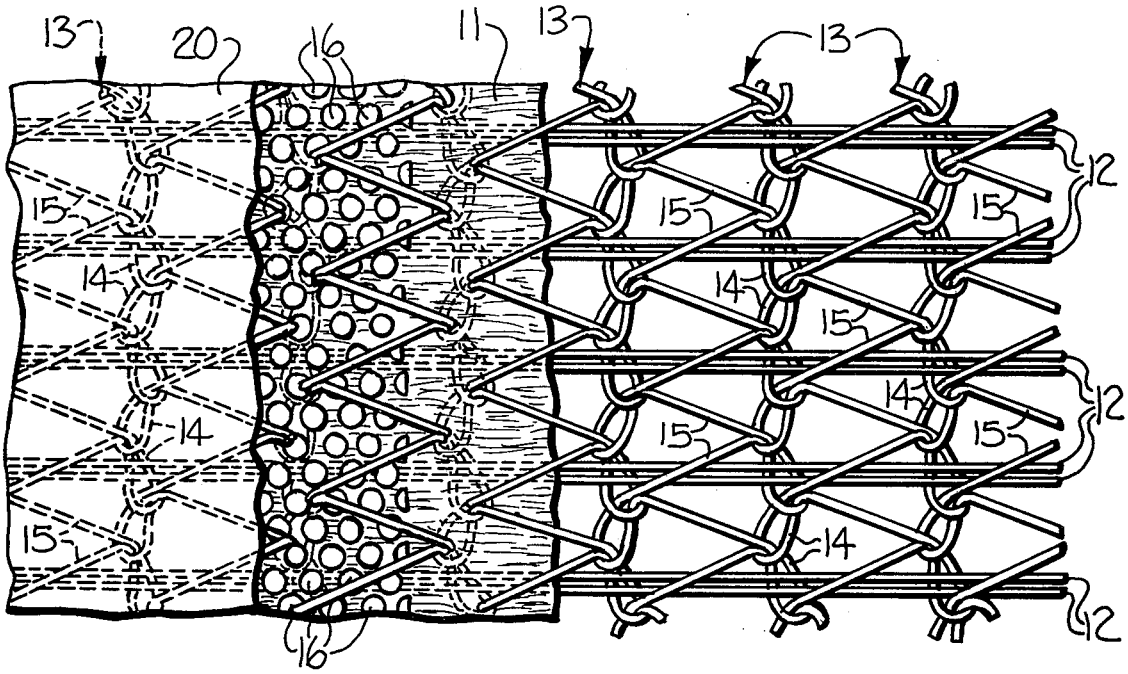
FIG. 1 is a fragmentary elevational view of a garment base fabric with one embodiment of the composite fusible interlining fabric of the present invention adhered or fused to the rear surface thereof and with the different components of the interlining fabric being broken away to illustrate the construction thereof.
Figure 2:
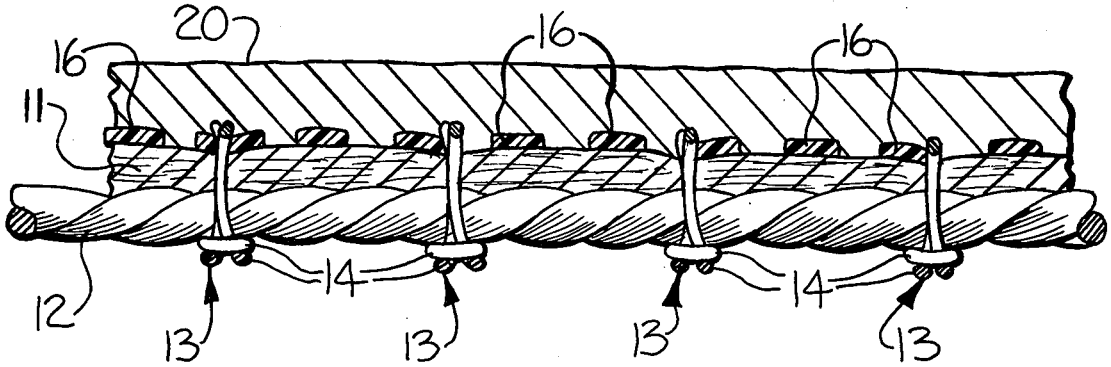
FIG. 2 is a greatly enlarged sectional view taken substantially along the line 2—2 in FIG. 1.

The embodiment of the composite fusible interlining fabric of the present invention illustrated in FIGS. 1 and 2 includes a relatively thin layer of nonwoven fabric 11, formed of closely compacted fibers, and a layer of fibrous material, illustrated as inlaid weft yarns 12, such as spun yarn. Stitch yarn, broadly indicated at 13, is knit in a warp knit stitch pattern through the layer of nonwoven fabric 11 and incorporates the inlaid weft yarns 12 therein. The stitch yarn 13 forms a plurality of side-by-side walewise extending stitch loop chains 14 on the reverse or back side of the composite fusible interlining fabric and forms diagonally extending laps 15 on the front or face side of the composite fusible interlining fabric. The laps 15 extend in a zig zag path between adjacent wales of stitch loop chains 14. Thus, the stitch yarn 13 is knit through and connects the layer of nonwoven fabric with the layer of fibrous material (spun yarn 12) and provides the strength, bulk, drapability and resiliency characteristics of conventional knit or woven interlining fabric. The layer of nonwoven fabric 11 provides the smooth surface characteristics of conventional nonwoven interlining fabric.

A coating of thermoactive adhesive material is illustrated as being applied to the front or face side of the nonwoven fabric 11; however, it may be applied to the composite interlining fabric. The coating of thermoactive adhesive material may be applied in any desired manner, such as the randomly arranged dots 16 of adhesive material shown in FIG. 1. The upper layer of nonwoven fabric 11 provides a relatively smooth surface for the application of the dots 16 of thermoactive adhesive material. The diameter and thickness of the dots 16 of thermoactive adhesive material have been greatly exaggerated in FIGS. 1 and 2. In the actual fabric, the dots of adhesive material are substantially invisible.

The body or base fabric, indicated at 20, is fused or bonded to the composite fusible interlining fabric by the application of heat and pressure to soften the dots 16 of adhesive or fusible material and to cause the same to adhere to the inner surface of the garment base fabric 20. The provision of the layer of nonwoven fabric 11 on the inner surface of the composite interlining fabric provides a barrier or shield of closely compacted fibers to prevent strike back of the thermoactive adhesive coating material when the composite interlining fabric is fused to the base fabric. The inlaid weft yarn 12 provides the desired resiliency, bulk, hand, body, drape and other characteristics to the fused garment.

As an example, it has been found that a satisfactory composite fusible interlining fabric can be formed by knitting a 40-denier polyester yarn while inlaying a spun (worsted or cotton) yarn in alternate courses, as illustrated in FIG. 1. However, it is to be understood that the inlaid weft yarn 12 may be inlaid in every course, if desired. The size and type of weft yarn 12 may be varied to change the above-mentioned characteristics of the composite fusible interlining fabric.

Figure 3:
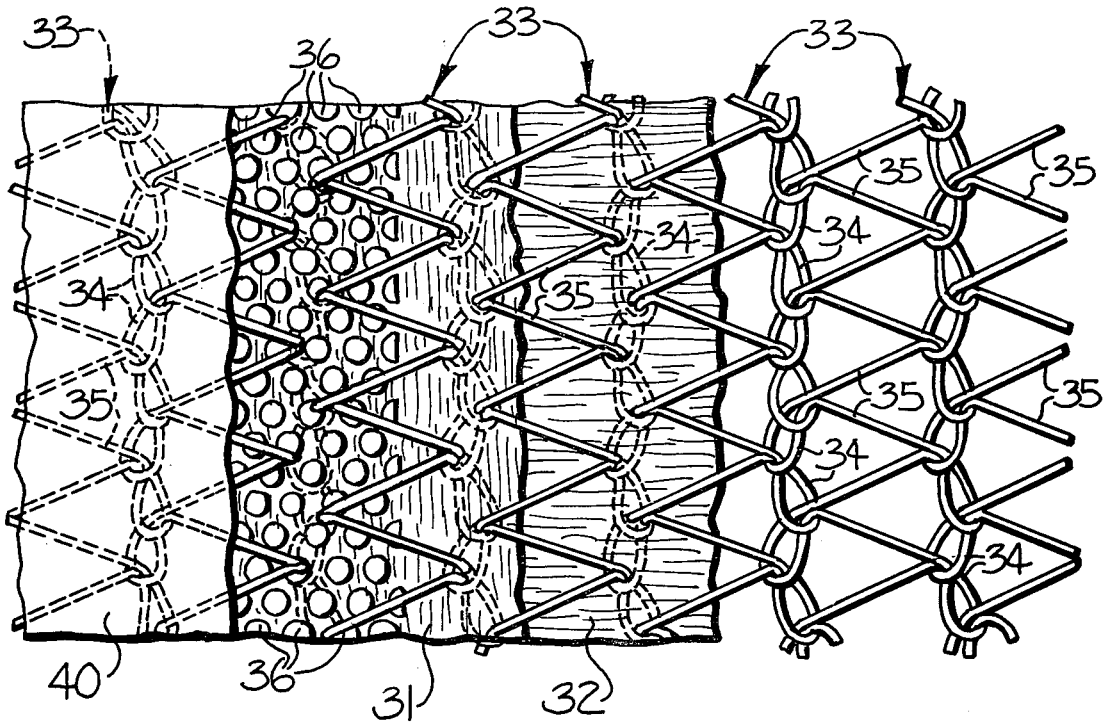
FIG. 3 is a view similar to FIG. 1 but showing a second embodiment of the composite fusible interlining fabric of the present invention.
Figure 4:
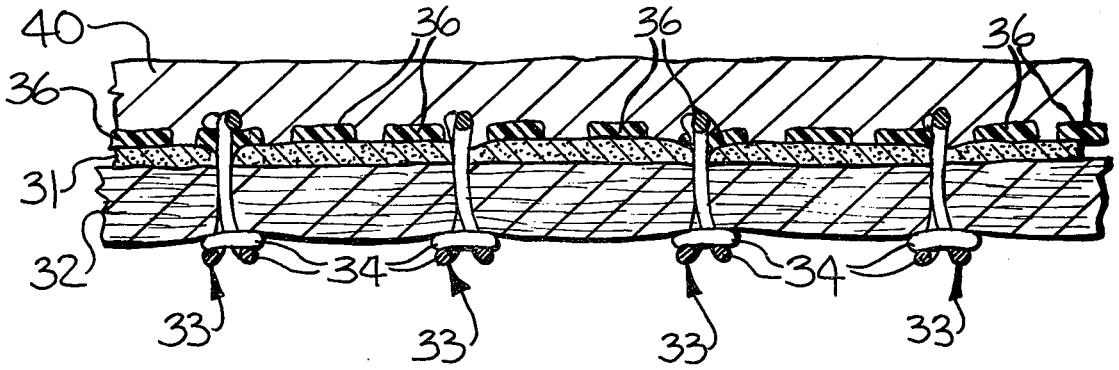
FIG. 4 is an enlarged sectional view taken substantially along the line 4—4 in FIG. 3.

The embodiment of the composite interlining fabric of the present invention illustrated in FIGS. 3 and 4 includes a relatively thin layer of nonwoven fabric 31 formed of closely compacted fibers and an additional layer of fibrous material, illustrated as a relatively thick nonwoven fibrous batt 32. The additional layer of nonwoven fibrous batt 32 is positioned against one side of the layer of nonwoven fabric 31 and stitch yarn, broadly indicated at 33, is knit through the layer of nonwoven fabric 31 and the nonwoven fibrous batt 32 to secure the two layers together. The stitch yarn 33 is knit in a warp knit stitch pattern and forms a plurality of side-by-side walewise extending stitch loop chains 34 on the reverse or back side of the composite interlining fabric.

The stitch yarn 13 also forms diagonally extending laps 35 on the other or face side of the composite interlining fabric. The laps 35 extend in a zig-zag path between adjacent wales of stitch loop chains 34 on the front or face side of the composite interlining fabric. Thus, the stitch yarn 33 is knit through and connects the relatively thin layer of nonwoven fabric 31 with the relatively thick additional layer of nonwoven fibrous batt 32 and provides the strength, body, and bulk characteristics of an interlining fabric of the type normally used in the chest piece and shoulder pad construction of a garment. The layer of nonwoven fabric 31, and the nonwoven fibrous batt 32, provide the smooth surface, strength, resiliency, drapability and bulk characteristics of conventional types of nonwoven, woven and knit interlining fabrics.

A coating of thermoactive adhesive material is applied to the front or face side of the nonwoven fabric 31, preferably before the nonwoven fibrous batt 32 is attached thereto by the stitch yarn 33. The coating of thermoactive adhesive material may be applied in any desired manner, such as the randomly arranged dots 36 of adhesive material down in FIG. 3. The relatively thin layer of nonwoven fabric 31 provides a relatively smooth surface for the application of the dots 36 of thermoactive adhesive material. The garment base fabric, indicated at 40, is fused or bonded to the composite fusible interlining fabric by the application of heat and pressure to soften the dots 36 of thermoactive adhesive material and to cause the same to adhere to the garment base fabric 40.

The provision of the layer of nonwoven fabric 31, formed of closely compacted fibers, on the front side of the composite fusible interlining fabric provides a barrier or shield to prevent the flow of the adhesive coating material into the relatively thick nonwoven fibrous batt 32 when the composite interlining fabric is fused to the base fabric 40. Also during subsequent pressing operations when the garment is subjected to pressure and heat the adhesive bond between the base garment fabric and the composite fusible fabric is maintained.

In both embodiments of the composite fusible interlining fabric, the coating of thermoactive adhesive material is fusible at a predetermined temperature which is lower than the temperature at which the other materials in the interlining fabric will be adversely affected so that the heat and pressure applied during the fusing of the interlining fabric to the base fabric will not affect the other materials of the interlining fabric. The composite fusible interlining fabric of the present invention permits the interlining manufacturer to economically form a wide variety of interlining fabrics with the proper characteristics for attachment to a wide variety of different types of garment fabrics.

For example, when it is desirable that the composite fusible interlining fabric should have a greater degree of flexibility in one direction than in the other direction, the composite interlining fabric may be formed with weft inlaid yarns as the layer of fibrous material. A wide variety of different types of weft inlaid yarns is also available and can be utilized to vary the resiliency, bulk, weight, strength and other characteristics of the composite fusible interlining fabric. Also, the characteristics of the composite fusible interlining fabric may be varied by varying the weight and type of nonwoven fibrous batt used in the reverse or back layer to provide the desired amount of bulk in the composite fusible interlining fabric.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A composite fusible interlining fabric adapted to be fused to a base fabric and characterized by the smooth surface characteristics of nonwoven interlining fabric and the strength, bulk, resiliency, and drapability characteristics of woven and knit interlining fabrics, said interlining fabric comprising a layer of nonwoven fabric of closely compacted fibers, a layer of inlaid weft yarns positioned against one side of said layer of nonwoven fabric, stitch yarn knit through said layer of nonwoven fabric and said layer of inlaid weft yarns and securing said inlaid weft yarns to said layer of nonwoven fabric, and a coating of thermoactive adhesive material on the side of said layer of nonwoven fabric opposite the side against which said layer of inlaid weft yarns is positioned, said coating of thermoactive adhesive material being fusible at a predetermined temperature which is lower than the temperature at which said layer of nonwoven fabric, said layer of inlaid weft yarns, said knit stitch yarn and the base fabric will be adversely affected, so that said composite interlining fabric may be fused to one side of the base fabric by the application of heat thereto, said layer of nonwoven fabric providing a barrier to prevent strike back of said adhesive coating material when said composite interlining fabric is fused to the base fabric.

2. A composite interlining fabric according to claim 1 wherein said stitch yarn is knit through said layer of nonwoven fabric and said layer of inlaid weft yarns in a warp knit stitch pattern.

3. A composite interlining fabric according to claim 2 wherein said warp knit construction includes a plurality of side-by-side stitch loop chains extending along the side of said layer of inlaid weft yarns opposite said layer of nonwoven fabric, and diagonally extending laps extending in a zig-zag path and interconnecting adjacent stitch loop chains, said laps being positioned on the side of said layer of nonwoven fabric opposite said layer of inlaid weft yarns.

4. A composite interlining fabric according to claim 1 wherein said coating of thermoactive adhesive material comprises a plurality of randomly spaced dots of adhesive material applied to said layer of nonwoven fabric.

5. A garment base fabric in combination with a composite interlining fabric fused to one side thereof and wherein said composite interlining fabric comprises a layer of nonwoven fabric of closely compacted fibers and having one side positioned adjacent said one side of said garment base, a coating of thermoactive adhesive material on said one side of said layer of nonwoven fabric and fusing the same to said garment base fabric, a layer of inlaid weft yarns having one side positioned against the other side of said layer of nonwoven fabric, and stitch yarn knit through said layer of nonwoven fabric and said layer of inlaid weft yarns, said layer of nonwoven fabric providing a barrier to prevent strike back of said coating of thermoactive adhesive material through said layer of inlaid weft yarns.

6. A method of forming a composite fusible interlining fabric adapted to be fused to a garment base fabric and having the smooth surface characteristics of nonwoven interlining fabric and the strength, bulk, resiliency and drapability characteristics of woven and knit interlining fabric, said method comprising the steps of forming a layer of nonwoven fabric of closely compacted fibers, applying a fusible coating of thermoactive adhesive material to one side of the layer of nonwoven fabric, and attaching a layer of inlaid weft yarns to the other side of the nonwoven fabric by knitting stitch yarn through the layer of nonwoven fabric and the layer of inlaid weft yarns, the layer of nonwoven fabric forming a barrier to prevent strike back of the fusible coating of thermoactive material when the composite fusible interlining fabric is fused to the garment base fabric.

7. A method according to claim 6 wherein the fusible coating thermoactive adhesive material is applied in the form of randomly arranged dots.

8. A method according to claim 6 wherein the layer of inlaid weft yarns is attached to the layer of nonwoven fabric by forming warp stitch loop chains of the stitch yarn therethrough.

* * * * *